US009505548B2

(12) United States Patent
Morand

(10) Patent No.: US 9,505,548 B2
(45) Date of Patent: Nov. 29, 2016

(54) STAND FOR AN ABSORBENT SHEET PRODUCT DISPENSER AND ABSORBENT SHEET PRODUCT DISPENSER INCLUDING SAME

(75) Inventor: Michel Morand, Verdun (CA)

(73) Assignee: CASCADES CANADA LLC, Montreal (CA)

( * ) Notice: Subject to any disclaimer, the term of this patent is extended or adjusted under 35 U.S.C. 154(b) by 0 days.

(21) Appl. No.: 14/238,924

(22) PCT Filed: Aug. 17, 2012

(86) PCT No.: PCT/CA2012/050565

§ 371 (c)(1),
(2), (4) Date: Feb. 14, 2014

(87) PCT Pub. No.: WO2013/023304

PCT Pub. Date: Feb. 21, 2013

(65) Prior Publication Data

US 2014/0202914 A1 Jul. 24, 2014

Related U.S. Application Data

(60) Provisional application No. 61/525,015, filed on Aug. 18, 2011.

(51) Int. Cl.

| | |
|---|---|
| ***A47K 10/24*** | (2006.01) |
| ***B65H 1/00*** | (2006.01) |
| ***B65D 85/16*** | (2006.01) |
| ***A47G 21/16*** | (2006.01) |

(52) U.S. Cl.

CPC ..... *B65D 85/16* (2013.01); *A47G 21/16* (2013.01)

(58) Field of Classification Search

CPC ..... A47K 10/18; A47K 10/42; G07F 11/44; G07F 13/10; B65G 59/061; B65D 85/16; A47G 21/16

USPC ..... 221/45, 92, 283; 206/494; 248/176.3; 439/534

See application file for complete search history.

(56) References Cited

U.S. PATENT DOCUMENTS

| | | | | |
|---|---|---|---|---|
| 553,833 | A | 2/1896 | Bower | |
| 1,563,078 | A | 11/1925 | Erdos | |
| 1,696,556 | A | 12/1928 | Schofer | |
| 1,832,040 | A | 11/1931 | Miller | |
| 3,470,330 | A * | 9/1969 | Brown | H04M 1/11 211/26 |
| 5,090,592 | A | 2/1992 | Petterson et al. | |
| 5,100,020 | A | 3/1992 | Petterson et al. | |
| 5,102,007 | A | 4/1992 | Petterson et al. | |
| 5,201,428 | A | 4/1993 | Pasinski et al. | |
| 5,221,011 | A | 6/1993 | Coto | |
| 5,457,745 | A * | 10/1995 | Wang | B60R 11/0241 379/426 |

(Continued)

FOREIGN PATENT DOCUMENTS

| | | | |
|---|---|---|---|
| GB | 1525080 | 9/1978 | |
| WO | WO 2008050549 A3 * | 6/2008 | H04M 1/0297 |
| WO | 2011002359 | 1/2011 | |

*Primary Examiner* — Rakesh Kumar

(74) *Attorney, Agent, or Firm* — Sutherland Asbill & Brennan LLP

(57) ABSTRACT

An absorbent sheet product dispenser comprising: a dispenser body for holding a stack of said absorbent sheet products; and a stand for supporting the dispenser body on a supporting surface, the stand being engageable with the dispenser body, wherein the dispenser body is configurable in at least two configurations relative to said supporting surface when engaged with the stand.

7 Claims, 8 Drawing Sheets

(56) References Cited

U.S. PATENT DOCUMENTS 5,722,628 A * 3/1998 Menaged ..... A47B 23/043 211/50
5,897,000 A 4/1999 Leanza
6,027,189 A 2/2000 Gunderson et al.
6,193,546 B1 * 2/2001 Sadler ..... A45F 5/02 439/165
6,290,534 B1 9/2001 Sadler
6,457,605 B2 10/2002 Coleman
6,522,748 B1 * 2/2003 Wang ..... B60R 11/02 379/446
6,669,162 B1 12/2003 Sears et al.
6,716,058 B2 * 4/2004 Youn ..... G06F 1/1632 439/165
6,789,694 B1 9/2004 McCullough
6,889,949 B2 5/2005 Sears et al.
6,892,898 B1 * 5/2005 Boone ..... A47K 10/424 221/213
6,899,251 B2 5/2005 Christensen et al.
D507,138 S 7/2005 Hochtritt et al.
6,988,635 B2 * 1/2006 Hochtritt et al. ..... 221/44
7,048,143 B2 5/2006 Sanders et al.
7,134,571 B2 11/2006 Hochtritt et al.
7,140,492 B2 11/2006 Julius
7,172,092 B2 * 2/2007 Yang ..... A47F 9/042 206/449
7,341,166 B2 * 3/2008 Reinsel ..... A47K 10/425 221/270
7,403,613 B2 * 7/2008 Liou ..... B60R 11/00 379/446
7,546,934 B2 6/2009 Reinsel et al.
7,624,881 B2 12/2009 Wilfong, Jr.
7,766,187 B2 * 8/2010 Schaefers ..... A47K 10/427 221/47
7,828,259 B2 * 11/2010 Wang ..... B60R 11/02 248/316.4
D630,873 S 1/2011 Kuehneman et al.
7,997,443 B2 * 8/2011 Titas ..... A47K 10/3818 16/386
2005/0056657 A1 * 3/2005 Hochtritt ..... A47K 10/424 221/45
2009/0014608 A1 * 1/2009 Yang ..... F16M 11/041 248/176.3
2009/0127276 A1 * 5/2009 Rippl ..... A47K 10/424 221/45
2010/0224744 A1 9/2010 Curatolo et al.
2012/0097701 A1 4/2012 Benedetti
2014/0130334 A1 * 5/2014 Chun ..... F16M 11/041 29/525.01
2015/0014344 A1 * 1/2015 Formon ..... A47K 10/424 221/45
2015/0014348 A1 * 1/2015 Tedesco ..... A47K 10/426 221/282
2015/0189771 A1 * 7/2015 Krohn ..... G06F 1/1632 248/451

* cited by examiner

STAND FOR AN ABSORBENT SHEET PRODUCT DISPENSER AND ABSORBENT SHEET PRODUCT DISPENSER INCLUDING SAME

CROSS-REFERENCE TO RELATED APPLICATIONS

This application claims priority under 35USC§119(e) of U.S. provisional patent application 61/525,015 filed on Aug. 18, 2011, the specification of which is hereby incorporated by reference. This application is a national phase entry of PCT patent application serial number PCT/CA2012/050565, filed on Aug. 17, 2012, (now pending) designating the United States of America.

TECHNICAL FIELD OF THE INVENTION

The technical field relates to a dispenser for sheet products having a stand and a dispenser body securable together in at least two configurations to vary a dispensing angle of the dispenser body. It also relates to a stand for receiving an absorbent sheet product dispenser body in at least two configurations.

BACKGROUND

Several types of napkin dispensers are available including, without being limitative, wall mounted dispensers, countertop dispensers, table dispensers, and dispensers mounted to a stand. These dispensers are all configured for serially dispensing products such as paper napkins and paper towels from a stack. They include a dispenser body configured for holding the stack of paper napkins or any other sheet products and have a dispensing opening through which napkins or the other sheet products are withdrawn either one-by-one or several at a time.

In some embodiments, the dispenser bodies are secured to a stand which supports the dispenser body on a supporting surface such as a table, a shelf, a countertop, or a wall. When the dispenser body is secured to the stand, the dispensing opening of the dispenser body is configured in a single and predetermined dispensing orientation (or dispensing angle).

However, depending on the properties of the supporting surface wherein the dispenser is disposed, for instance its height and/or its depth, it may be desirable to modify the dispensing angle, i.e. the angle defined between the dispensing body and the supporting surface to which the dispenser is mounted.

BRIEF SUMMARY OF THE INVENTION

It is therefore an aim of the present invention to address the above mentioned issues.

According to a general aspect, there is provided an absorbent sheet product dispenser comprising: a dispenser body for holding and dispensing a stack of absorbent sheet products; and a stand for supporting the dispenser body on a supporting surface, the stand being engageable with the dispenser body, with the dispenser body being configurable in at least two configurations relative to the supporting surface when engaged with the stand.

In an embodiment, the stand comprises a base and a dispenser body support engageable together in at least two configurations and the dispenser body being securable to the dispenser body support in a single configuration. The base and the dispenser body support can be detachably engageable together.

In an embodiment, at least one of the base and the dispenser body support comprises a plurality of female member sets, each one of the female member sets including at least one female member and corresponding to one of the at least two configurations, and the other one of the base and the dispenser body support comprises at least one male member, complementary to the female members and selectively engageable with a respective one of the female member sets.

In an alternative embodiment, at least one of the base and the dispenser body support comprises a plurality of male member sets, each one of the male member sets including at least one male member and corresponding to a one of the at least two configurations, and the other one of the base and the dispenser body support comprises at least one female member, complementary to the male members and selectively engageable with a respective one of the male member sets.

The female members can comprise elongated grooves and the at least one male member can comprise at least one projecting flange complementary to the elongated grooves.

In an embodiment, the base and the dispenser body support are pivotally engageable together and configurable in a plurality of configurations by pivoting the dispenser body support with respect to base and wherein the dispenser body is securable to the dispenser body support in a single configuration.

In an embodiment, the dispenser body and the stand are pivotally engageable together and configurable in the at least two configurations by pivoting the dispenser body with respect to the stand.

In an embodiment, one of the dispenser body and the stand comprises a plurality of female member sets, each one of the female member sets including at least one female member and corresponding to a respective one of the at least two configurations, and the other one of the dispenser body and the stand comprises at least one male member, complementary to the female members and selectively engageable with a respective one of the female member sets to configure the dispenser body in a corresponding one of the at least two configurations.

The absorbent sheet product dispenser as claimed in claim 1, wherein one of the dispenser body and the stand comprises a plurality of male member sets, each one of the male member sets including at least one male member and corresponding to a respective one of the at least two configurations, and the other one of the dispenser body and the stand comprises at least one female member, complementary to the male members and selectively engageable with a respective one of the male member sets to configure the dispenser body in a corresponding one of the at least two configurations.

The dispenser body and the stand can be detachably engageable together.

According to another general aspect, there is provided an absorbent sheet product dispenser comprising: a base mountable to a supporting surface and a dispenser body support for receiving a dispenser body, one of the base and the dispenser body support includes at least two sets of female members and the other one of the base and the dispenser body support includes at least one male member complementary to the female members and selectively engageable with a respective one of the sets of female members to secure the base and the dispenser body support together, the dispenser body support being configurable in at least two configurations, each one of the at least two configurations corresponding to a respective one of the sets of female members.

In an embodiment, the base and the dispenser body support are detachably securable together.

The female members can comprise elongated grooves and the at least one male member can comprise at least one projecting flange complementary to the elongated grooves.

In an embodiment, the base comprises the female members and the dispenser body support comprises the at least one male member.

In an embodiment, each one of the sets of female members comprises at least two female members. The sets of female members can comprise sets of elongated grooves and the sets of elongated grooves can extend substantially parallel to one another.

According to another general aspect, there is provided an absorbent sheet product dispenser comprising: a dispenser body for holding a stack of absorbent sheet products; and a stand for supporting the dispenser body on a supporting surface, one of the dispenser body and the stand includes at least one female member and the other one of the stand and the dispenser body includes at least one male member complementary to the at least one female member, at least one of the at least one female member and the at least one male member comprising at least two sets thereof and the other one being selectively engageable with a respective one of the sets to secure the stand and the dispenser body together, the dispenser body being configurable in at least two configurations, each one of the configurations corresponding to a respective one of the sets.

In an embodiment, the dispenser body comprises a housing for holding the stack of absorbent sheet products and a dispenser body support securable together, the dispenser body support being engageable with the stand.

In an embodiment, the stand and the dispenser body are detachably engageable together.

In an embodiment, the stand comprises the at least one female member and the at least one female member comprises the at least two sets and the dispenser body comprises the at least one male member selectively engageable with a respective one of the at least two sets of female members. Each one of the sets of female members can comprise at least two female members. The at least two female members can comprise at least two elongated grooves and the at least one male member can comprise at least two projecting flanges complementary to the at least two elongated grooves. The sets of elongated grooves can extend substantially parallel to one another.

The supporting surface can be a horizontally oriented supporting surface.

In this specification, the term "absorbent sheet product" is intended to include paper products such as paper napkins and paper towels but also nonwoven material not normally classified as paper or tissue.

BRIEF DESCRIPTION OF THE DRAWINGS

FIG. 6 includes FIGS. 6*a*, 6*b*, and 6*c*.

It will be noted that throughout the appended drawings, like features are identified by like reference numerals.

DETAILED DESCRIPTION

Figure 1:
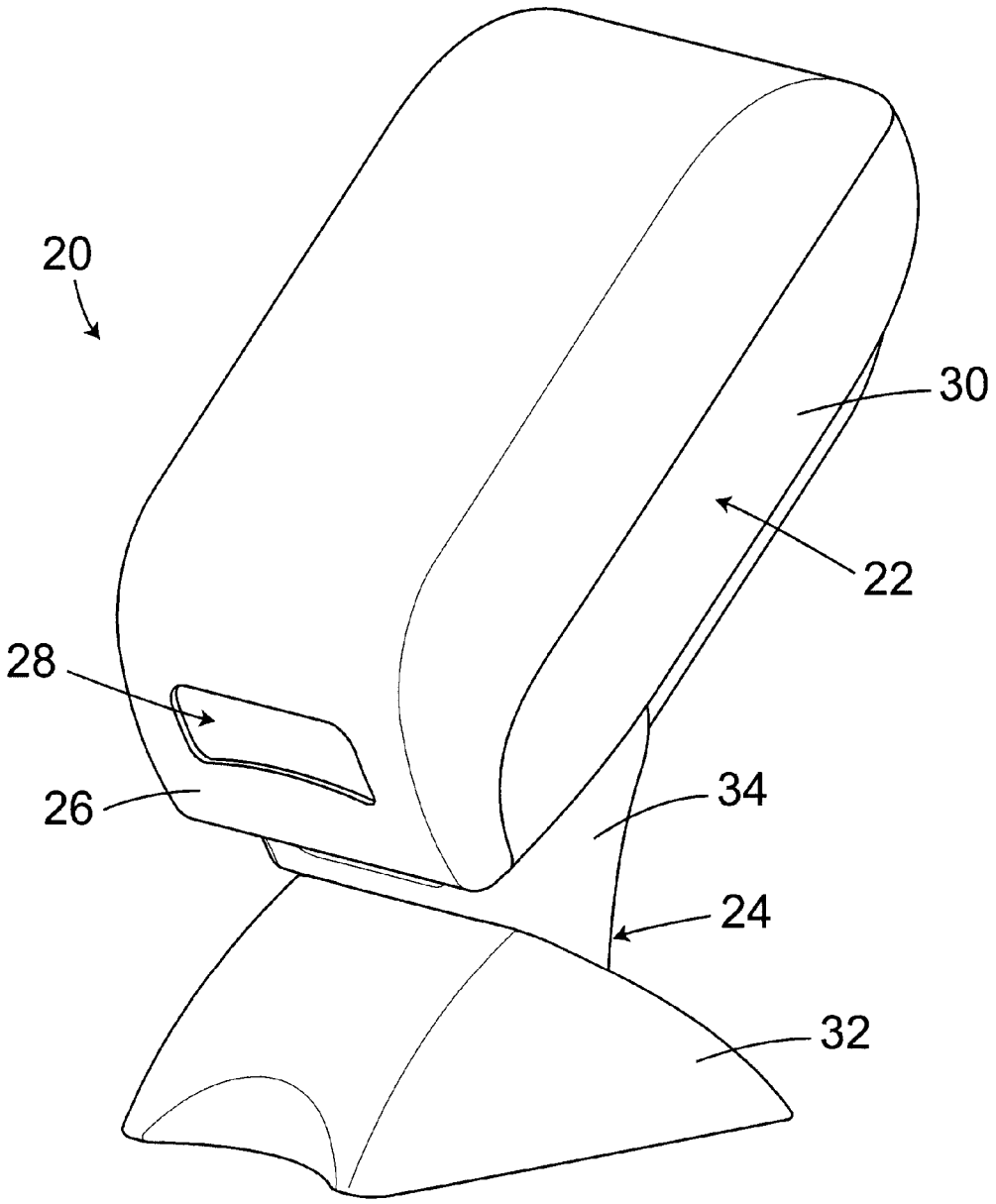
FIG. 1 is a front perspective view of an absorbent sheet product dispenser mounted to a stand in accordance with an embodiment.

Referring now to the drawings and, more particularly, referring to FIG. 1, there is shown an embodiment of an absorbent sheet product dispenser 20 including a dispenser body 22, configured to contain a stack of absorbent sheet products such as but without being limitative paper napkins and paper towels, and a stand 24, configured to support the dispenser body 22 on a supporting surface such as a horizontal surface.

When mounted to the stand 24, the dispenser body 22 terminates downwardly with a faceplate 26 having a dispensing opening 28 defined therein through which napkins or other absorbent sheet products (not shown) are withdrawn. One skilled in the art will appreciate that the dispensing opening 28 can be configured to dispense the napkins one-by-one or a plurality of napkins simultaneously.

Furthermore, one skilled in the art will appreciate that the faceplate 26 can be removably mounted to a housing 30 of the dispenser body 22 or it can be formed in one piece with, or permanently secured to, the housing 30 of the dispenser body 22.

One skilled in the art will appreciate that the shape of the dispenser body 22, including the shape of the faceplate 26 and the dispensing opening 28, can vary from the embodiment shown in the accompanying drawings. Furthermore, in alternative implementations, the dispensing opening 28 can be defined anywhere in the housing 30. For instance, it can be provided on any one of the walls of the housing 30 such as and without being limitative, a top wall of the housing 30.

The stand 24 supports the dispenser body 22 on a supporting surface. In the embodiment shown, the supporting surface is an underlying horizontally oriented surface 36 (FIGS. 5 and 6) such as a table, a countertop, a shelf, and the like. It also positions the dispenser body 22 at the desired angle relative to the supporting surface, such as the underlying horizontally oriented surface 36, as it will be described in more details below.

Figure 2:
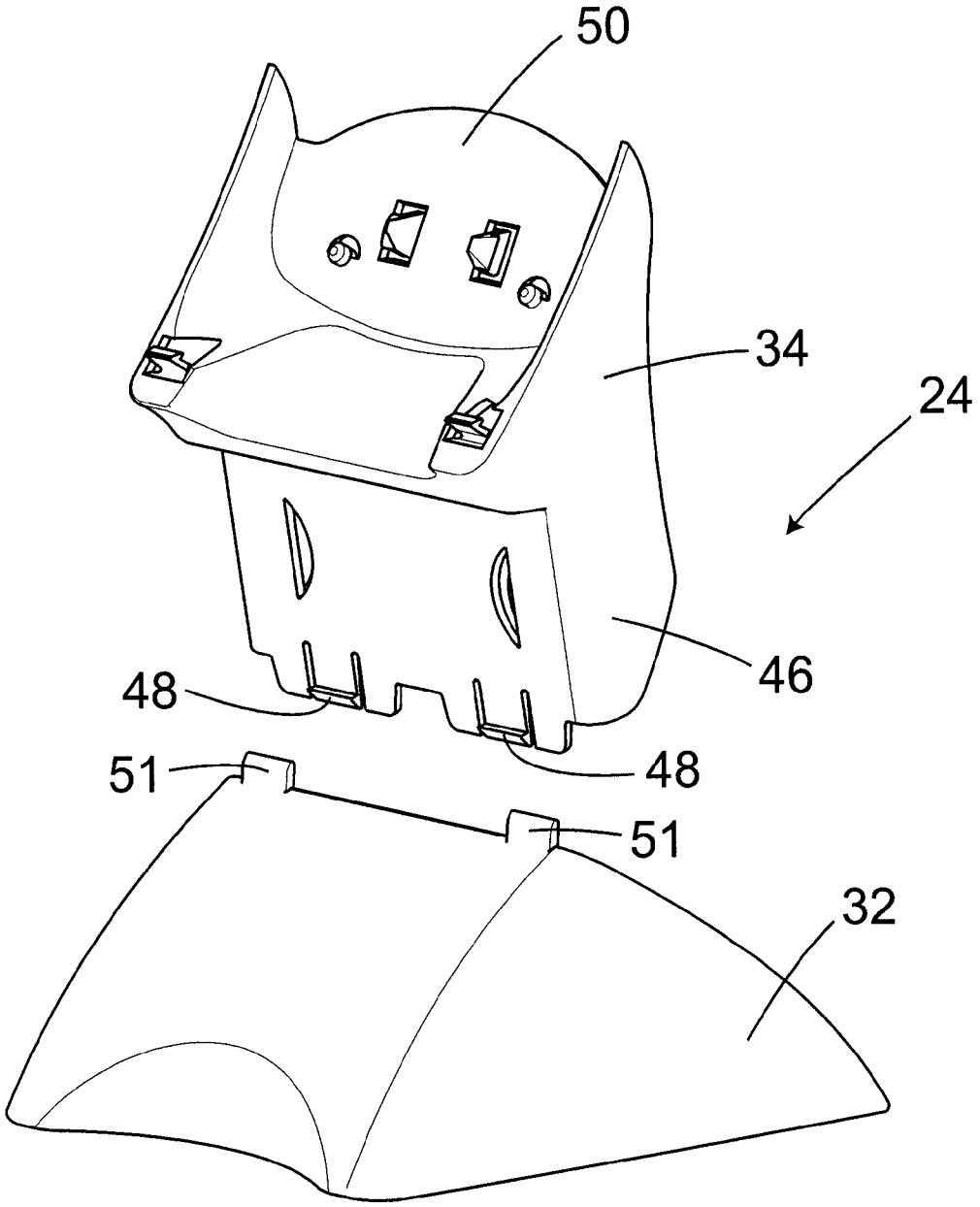
FIG. 2 is a front perspective view of the stand for the absorbent sheet product dispenser shown in FIG. 1 in accordance with an embodiment wherein a base and a dispenser body support of the stand are detached from one another.
Figure 3:
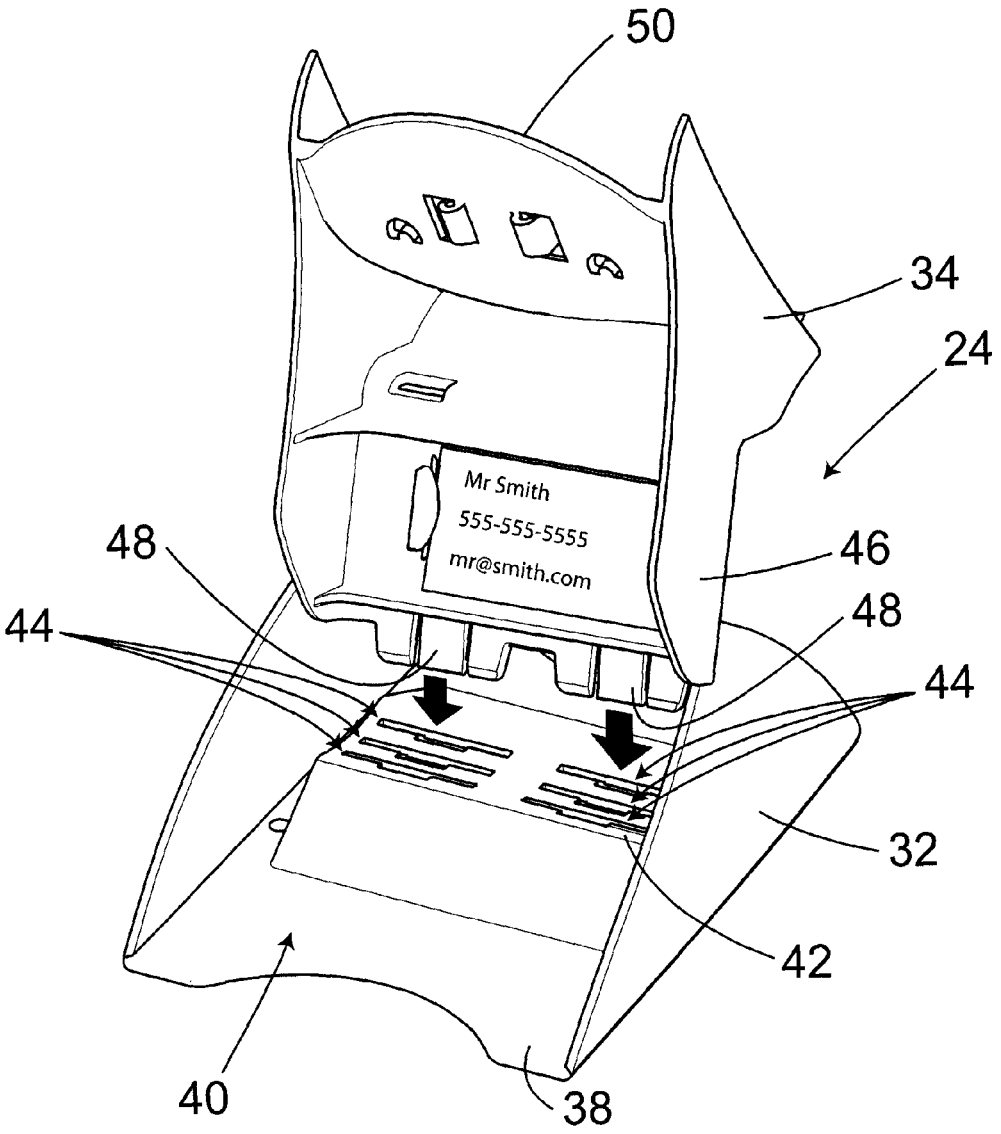
FIG. 3 is a top and rear perspective view of the stand shown in FIG. 2.
Figure 4:
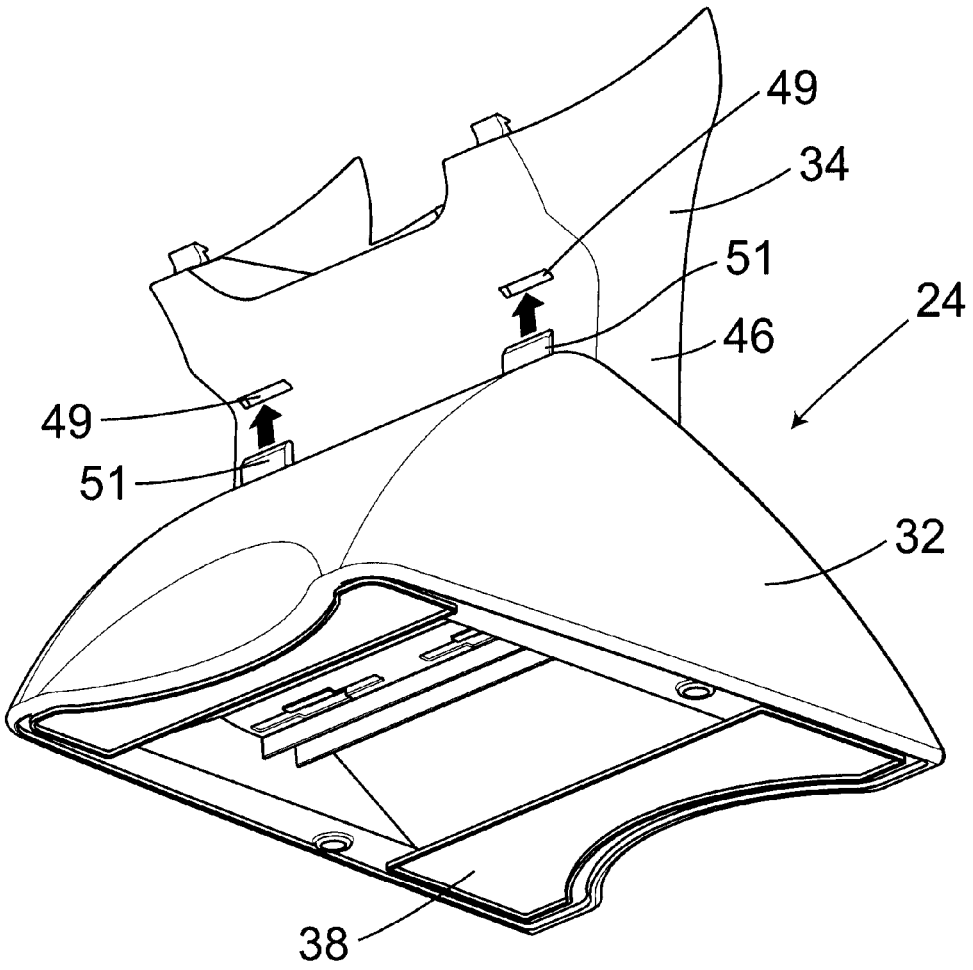
FIG. 4 is a bottom and rear perspective view of the stand shown in FIG. 2 wherein the base and the dispenser body support are being engaged together.

In the implementations shown in FIGS. 2 to 8, the stand 24 includes two detachably engageable components and, more particularly, a base 32 and a dispenser body support 34. In FIGS. 2 to 4, the base 32 and the dispenser body support 34 are disengaged from one another while in FIGS. 5 to 8, the base 32 and the dispenser body support 34 are engaged together. As it will be described in more details below, the base 32 and the dispenser body support 34 are engageable together in a plurality of configurations, each being characterized by an angle characterized between the dispenser body support 34 secured to the base 32 and the horizontal surface 36 on which the base 32 is disposed. As mentioned above, the dispenser body 22 is securable to the dispenser body support 34. Therefore, the configuration of the dispenser body 22 is modified simultaneously when the dispenser body support configuration is modified. In other words, the dispensing angle of the dispenser 20 can be varied by selectively configuring the base 32 and the dispenser body support 34 in one of the plurality of possible configurations. The dispensing angle corresponds to the angle defined between the dispenser body 22 and the supporting surface, such as the horizontal surface 36, to which the dispenser 20 is mounted.

Referring to FIGS. 2 and 3, there is shown that the base 32 includes a support surface 38 (or lower surface), a rear cavity 40, and a platform 42 extending upwardly in the rear cavity 40. The platform 42 has a plurality of female members 44 defined therein. More particularly, in the embodiment shown, the female members 44 include elongated grooves 44 extending parallel to one another. In the embodiment shown, the platform 42 has three rows (or sets) of elongated grooves 44, wherein each one of the rows includes two spaced-apart elongated grooves 44 (or a pair of spaced-apart elongated grooves 44). Each one of the rows constitutes a set of elongated grooves 44 and a possible configuration of the dispenser 20. The purpose of the female members 44 (or the elongated grooves) will be described in more details below.

The dispenser body support 34 is engageable with the base 32 in a plurality of possible configurations. It includes a lower section 46 with male members 48 detachably engageable with the female members 44 of the base 32. Thus, the shape and the configuration of the male members 48 are complementary to the shape and the configuration of the female members 44 to be detachably engageable therewith. In the embodiment shown, the male members 48 include a pair of projecting flanges 48 simultaneously insertable in one of the pair of elongated grooves 44. Thus, when the base 32 and the dispenser body support 34 are engaged together, the projecting flanges 48 are inserted in one of the pair of elongated grooves 44 defining a set in the platform 42.

One skilled in the art will appreciate that the shape, the number, and the configuration of the female and male members 44, 48 can vary from the embodiment shown. Furthermore, in an alternative embodiment, the base 32 can include the male members and the dispenser body support 34 can include the complementary female members. Furthermore, in the embodiment shown, the female and male members 44, 48 are detachably engageable together, thereby allowing reconfiguration of the dispenser 20 in any one of the possible configurations. In alternative implementations, the female and male members 44, 48 can be permanently engageable together, i.e. without allowing disengagement once they are engaged together and thereby preventing reconfiguration of the dispenser 20 in any one of the possible configurations.

In the embodiment shown, each set of female members 44 includes a pair of female members 44. However, in alternative embodiments, each set of female members 44 can include one or more than one female member 44. For instance and without being limitative, each set can include three female members. Furthermore, in an alternative embodiment wherein the stand includes a plurality of sets of male members engageable in corresponding female member(s), each set of male members 48 can include one or more than one male member 48.

Figure 5:
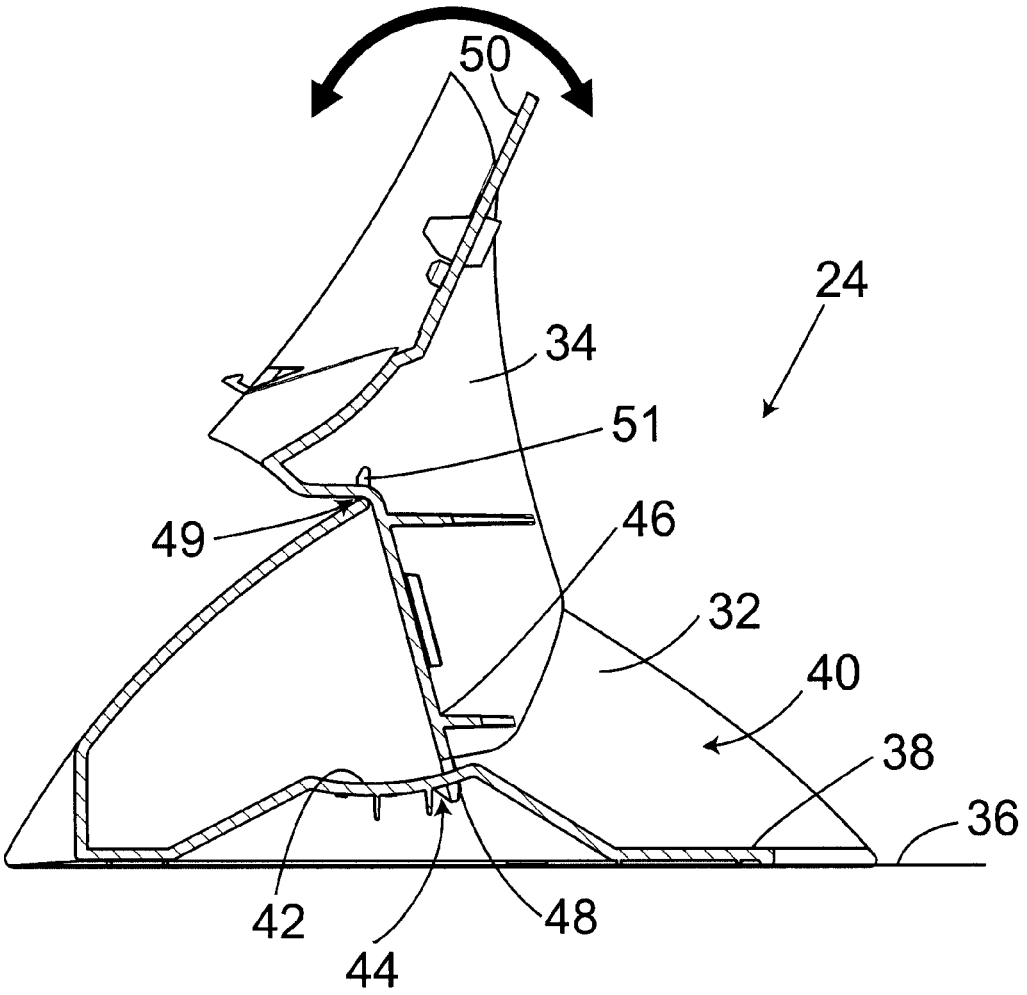
FIG. 5 is a cross-sectional view of the stand shown in FIG. 2 wherein the base and the dispenser body support are engaged together in a first and upright configuration.

As shown in FIGS. 4 and 5, the dispenser body support 34 further includes a pair of spaced-apart grooves 49 (or female members) and the base 32 includes a pair of complementary spaced-apart flanges 51 (or male members) that protrude upwardly from the base 32. The flanges 51 are detachably engageable in the grooves 49 when securing the dispenser body support 34 to the base 32. In the embodiment shown, the flanges 51 are inserted in the grooves 49 for any one of the possible configurations. They act as a pivoting point for configuring the stand 24 in one of the possible configurations. The complementary grooves 49 and flanges 51 stabilize the stand 24. One skilled in the art will appreciate that the shape, the number, and the configuration of the grooves 49 and the flanges 51 can vary from the embodiment shown. Furthermore, in an alternative embodiment, the base 32 can include the female members and the dispenser body support 34 can include the complementary male members. Furthermore, in alternative implementations, the grooves 49 and the flanges 51 can be engageable together without allowing disengagement once they are engaged together. In an alternative embodiment, the base 32 and the dispenser body support 34 can be free of additional and complementary male and female members.

The dispenser body support 34 further includes a dispenser body receiving surface 50 conceived to receive and secure the dispenser body 22 thereon. Exemplary embodiments of the dispenser body receiving surface 50 will be described in more details below in reference to FIGS. 7 and 8.

As mentioned above, to engage the dispenser body support 34 and the base 32 together, the projecting flanges 48 of the dispenser body support 34 are selectively inserted in one pair of elongated grooves 44 defining one of the sets as shown in FIG. 5. Thus, in the embodiment shown, the dispenser body support 34 can be configured in three alternative and possible configurations with respect to the base 32. The three configurations are shown in FIGS. 6*a* to 6*c* respectively and will be described in more details below.

In FIG. 5, the projecting flanges 48 are inserted in a first set of elongated grooves 44 wherein the dispenser body support 34 and the dispenser body 22 secured to the dispenser body support 34 (not shown) are configured in a first and upright configuration. To modify the angle of the dispenser body support 34 and the dispenser body 22 secured thereto, the projecting flanges 48 can be selectively inserted in another set of elongated grooves 44.

Figure 6A:
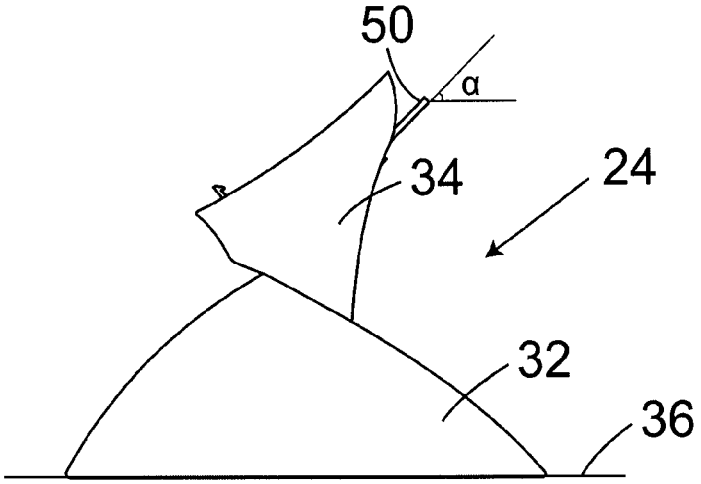
FIG. 6*a* is a side elevation view of the stand wherein the base and the dispenser body support are engaged together in a second and inclined configuration.
Figure 6B:
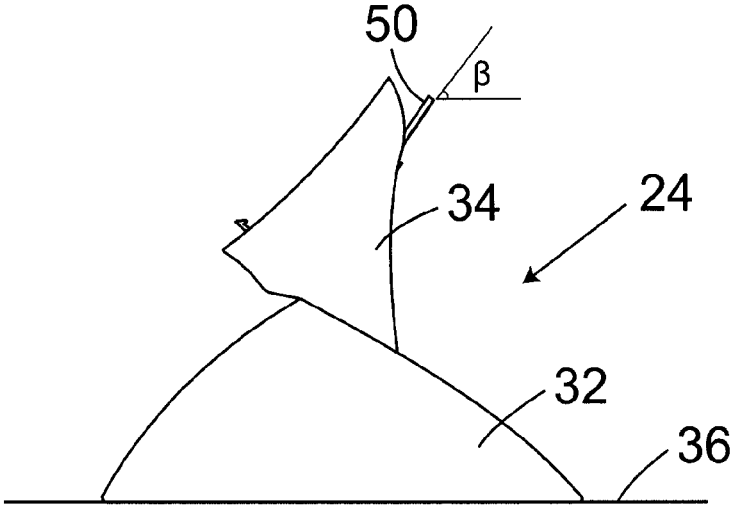
FIG. 6*b* is a side elevation view of the stand wherein the base and the dispenser body support are engaged together in a third and intermediate configuration.
Figure 6C:
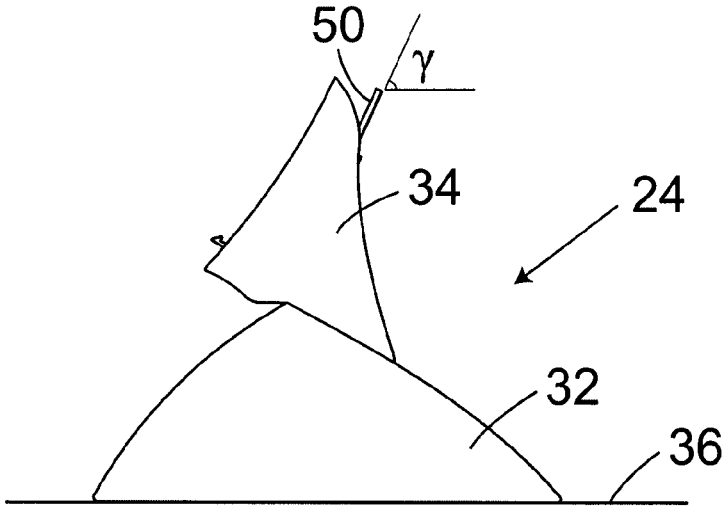
FIG. 6*c* is a side elevation view of the stand wherein the base and the dispenser body support are engaged together in the first and upright configuration of FIG. 5.

In FIGS. 6*a* to 6*c*, the three configurations that correspond to the three rows of elongated grooves 44 defined in the base 32 are shown. In FIGS. 6*a* to 6*c*, the dispensing angle is represented as the angle defined between the dispenser body receiving surface 50, to which the dispenser body 22 is securable, and the supporting surface 36, which is horizontally oriented. In FIG. 6*a*, the dispenser body support 34 is configured in a second and inclined configuration where the projecting flanges 48 are inserted in a third set of elongated grooves 44 (opposed to the set). In this configuration, the dispenser body receiving surface 50 defines an angle α with the horizontal surface 36. In FIG. 6*b*, the dispenser body support 34 is configured in a third and intermediate configuration where the projecting flanges 48 are inserted in a second set of elongated grooves 44, extending between the first set and the third set. In this configuration, the dispenser body receiving surface 50 defines an angle β with the horizontal surface 36. Finally, in FIG. 6*c*, the dispenser body support 34 is configured in the first and upright configuration where the projecting flanges 48 are inserted in the first set of elongated grooves 44; this configuration corresponds to the configuration shown in FIG. 5. In this configuration, the dispenser body receiving surface 50 defines an angle γ with the horizontal surface 36. The angle α is smaller than the angles β and γ, with β being smaller than γ. Thus, the dispenser 20 is selectively configurable in three configurations, each configuration being characterized by a different angle defined between the dispenser body receiving surface 50 and the horizontal surface 36, as supporting surface.

Thus, the projecting flanges 48 can be disengaged from one set of elongated grooves 44 and selectively engaged with another set of elongated grooves 44 to modify the configuration of the dispenser body support 34 with respect to the base 32 and the horizontal surface 36 to which the dispenser 20 is mounted. The dispensing angle of the dispenser body 22 secured to the dispenser body support 34 can thus be modified.

One skilled in the art will appreciate that several alternatives can be foreseen to the above described embodiment. For instance and without being limitative, the shape, the configuration, and the design of the stand 24 including the base 32 and the dispenser body support 34 can vary from the embodiment shown in the accompanying drawings. Also, the complementary female and male members can vary from the embodiment shown. For instance and without being limitative, the base 32 can include more or less than three sets of female members, the sets of female members can be configured in a non-parallel configuration with respect to one another, with each set including at least one female member. In a non-limitative embodiment, the base 32 can be provided with male members while the dispenser body support 34 can be provided with complementary female members.

In an alternative embodiment (not shown), one of the base 32 and the dispenser body support 34 can be provided with only one set of female member(s) while the other one of the base 32 and the dispenser body support 34 can be provided with a plurality of sets of male member(s). Thus, one set of male member(s) is selectively inserted in the set of female member(s) to secure the base 32 and the dispenser body support 34 in the selected configuration. For instance and without being limitative, the base 32 can include one set of female members while the dispenser body support 34 includes three sets of male members. One of the sets of male members is inserted in the set of female members to secure the base 32 and the dispenser body support 34 in the selected configuration.

Figure 7:
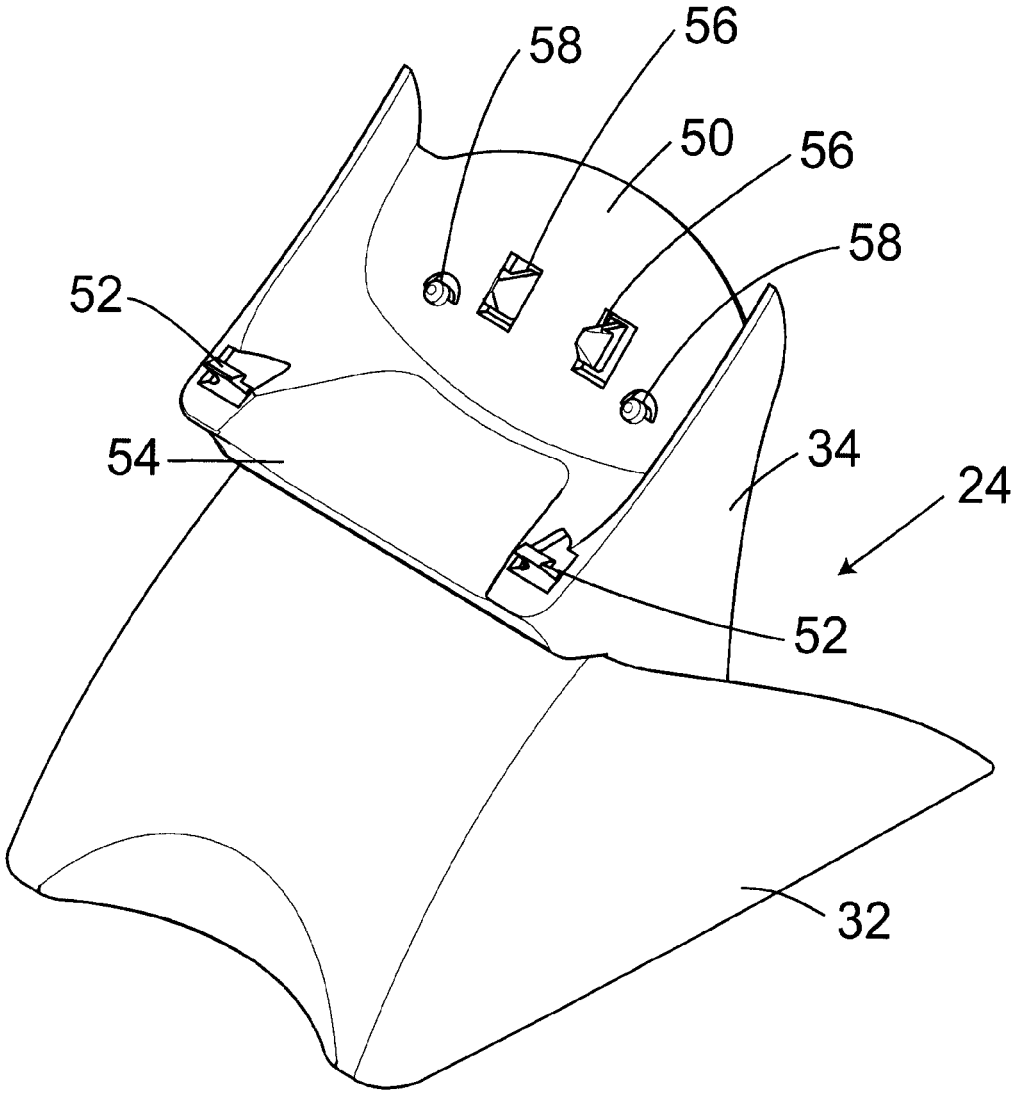
FIG. 7 is a front perspective view of the stand shown in FIG. 2 wherein the base and the dispenser body support are engaged together and the dispenser body support includes a first embodiment of dispenser body fasteners.
Figure 8:
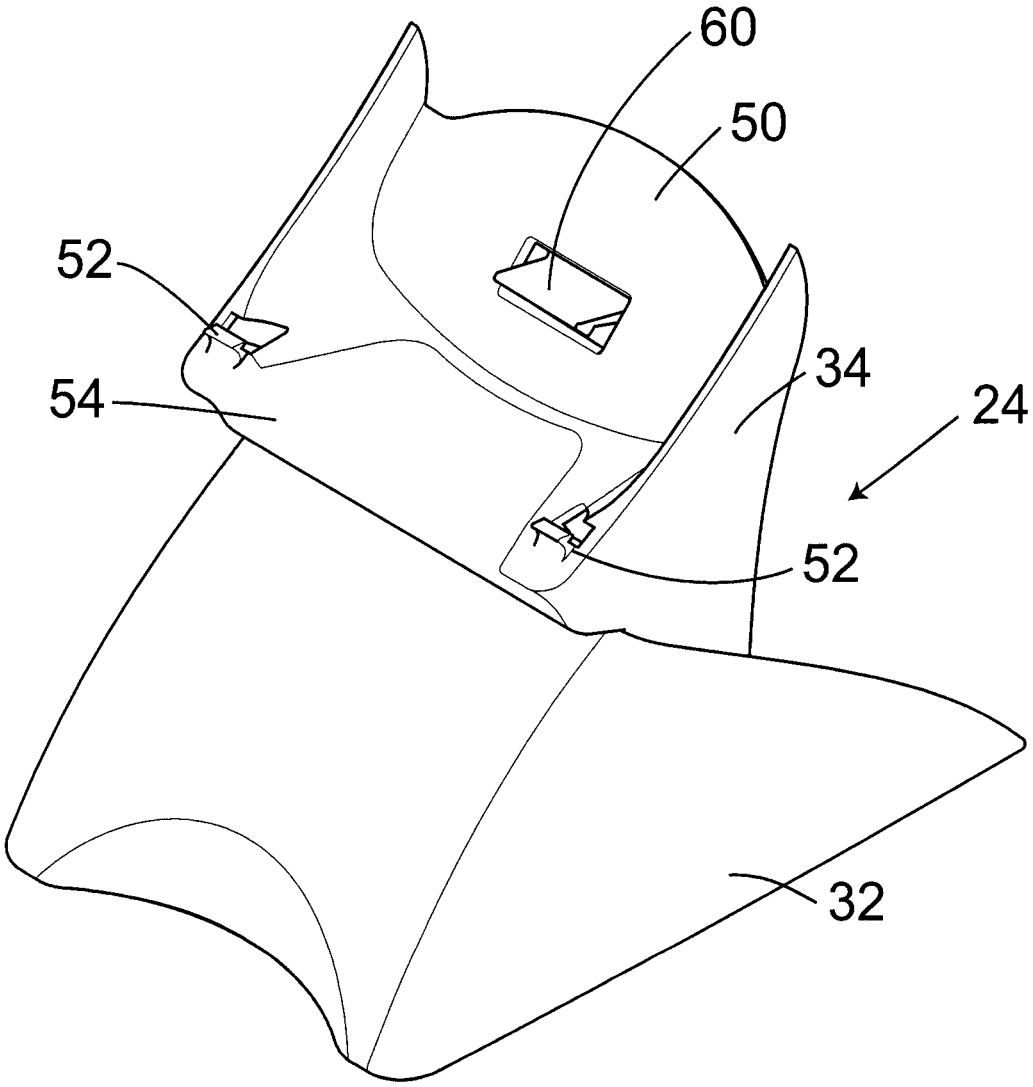
FIG. 8 is a front perspective view of the stand in accordance with another embodiment wherein the base and the dispenser body support are engaged together and the dispenser body support includes a second embodiment of dispenser body fasteners.

FIGS. 7 and 8 show two embodiments of mechanical mechanisms for securing the dispenser body 22 to the dispenser body support 34 of the stand 24.

In the embodiment shown in FIG. 7, the dispenser body receiving surface 50 includes a pair of hook members 52 projecting from a lower portion 54 of the dispenser body receiving surface 50, wherein the hooks project upwardly, and a pair of central hook members 56, wherein the hooks project outwardly, i.e. in opposed directions. The dispenser body receiving surface 50 further includes two spaced-apart protrusions 58, each one of the protrusions 58 being provided on a respective side of the central hook members 56. The hook members 52, 56 and the protrusions 58 are engageable in the complementary and corresponding female members (not shown), such as openings, defined in a rear face of the dispenser body 22. In the embodiment shown, the dispenser body support 34 of the stand 24 and the dispenser body 22 are securable together in a single configuration. To modify the configuration of the dispenser body 22 with respect to the horizontal surface 36 to which it is mounted, the configuration of the dispenser body support 34 and the base 32 defining the stand 24 must be modified as detailed above.

In the embodiment shown in FIG. 8, the dispenser body receiving surface 50 includes a pair of hook members 52 projecting from the lower portion 54 of the dispenser body receiving surface 50, wherein the hooks project upwardly, and a single central hook member 60, wherein the hook projects downwardly, i.e. towards the lower hook members 52. The hook members 52, 60 are engageable in complementary and corresponding female members (not shown) defined in the rear face of the dispenser body 22. As in the embodiment shown in FIG. 7, in the embodiment shown in FIG. 8, the dispenser body support 34 of the stand 24 and the dispenser body 22 are securable together in a single configuration.

One skilled in the art will appreciate that the number, configuration, and type of dispenser body fasteners such as the hook members 52, 56, and 60 and the protrusions 58 can vary from the embodiments described above in reference to FIGS. 7 and 8. For instance and without being limitative, in an embodiment, the dispenser body fasteners can include screws or other suitable mechanical fasteners engageable simultaneously with the dispenser body 22 and the stand 24. The dispenser body 22 can be permanently secured to the dispenser body support 34.

In the embodiment shown, the dispenser body 22 is detachably securable to the stand 24. However, in alternative embodiments (not shown), the stand 24 can be permanently secured to the dispenser body 22, i.e. once the dispenser body 22 is secured to the stand 24, it cannot be detached.

Furthermore, in the embodiments shown, the stand 24 includes two components and, more particularly, the base 32 and the dispenser body support 34 securable together and securable to the dispenser body 22. However, in alternative embodiments (not shown), the stand 24 can include one component or more than two components engageable with one another.

In an embodiment (not shown), the dispensing angle is varied by modifying the configuration of the dispenser body 22 with respect to the stand 24. For instance, the dispenser body 22 can include one of the male member(s) and the female member(s) and the stand 24 can include the other one of the complementary male member(s) and the female member(s). The dispenser body 22 and/or the stand 24 include a plurality of male or female members to offer a plurality of possible configurations. For instance and without being limitative, in an embodiment, the dispenser body 22 can be provided with the male member(s) and the stand 24 can be provided with a plurality of sets of complementary female member(s), wherein each one of the sets corresponds to a possible configuration. All the alternative embodiments detailed above for the two-component stand can be foreseen for the dispenser body engageable with the stand in a plurality of configurations.

The dispenser body 22 is secured to the stand 24 in a selected configuration in accordance with the supporting surface where the assembly including the stand 24 and the dispenser body 22 is disposed. If needed and possible, the dispenser body 22 can be detached from the stand 24 and the configuration of the assembly can be modified and re-secured together to modify the configuration including the dispensing angle.

One skilled in the art will appreciate that alternatives can be foreseen to configure the dispenser body 22 in a plurality of configurations with respect to the stand 24. In a non-limitative alternative embodiment, the dispenser body 22 can be pivotally mounted to the stand 24 through hinges or a pivot axis. Thus, to modify the configuration of the dispenser body 22 including its dispensing angle, the dispenser body 22 is pivoted with respect to the stand 24. If needed, the pivoting mechanism can include blockers to secure the dispenser body 22 in the selected configuration.

In an alternative embodiment, the stand 24 includes at least two components pivotally connectable to one another through hinges or a pivot axis, for instance. To modify the configuration of the dispenser, the two pivotally connected components are pivoted with respect to one another. If needed, the pivoting mechanism can include blockers to secure the stand 24 in the selected configuration.

In an alternative embodiment (not shown), the stand 24 can be configured to support the dispenser body 22 on a surface which is not compulsorily horizontal. For instance and without being limitative, the stand can be designed to mount the dispenser body 22 to a vertical surface and can be designed to configure the dispenser body 22 in at least two dispensing configurations with different angles with respect to the vertical surface to which it is mounted.

In some implementations, the dispenser body support 34 can be considered as part of the dispenser body 22. In these implementations, the dispenser body support 34 is securable to the housing 30 of the dispenser body 22 in a single configuration and securable to the stand base 32 into a plurality of configurations, each configuration corresponding to a configuration of the dispenser body 22 with respect to a supporting surface.

Although the embodiments of the absorbent sheet product dispenser and corresponding parts thereof consist of certain geometrical configurations as explained and illustrated herein, not all of these components and geometries are essential to the invention and thus should not be taken in their restrictive sense. It is to be understood, as also apparent to a person skilled in the art, that other suitable components and cooperation thereinbetween, as well as other suitable geometrical configurations, may be used for the absorbent sheet product dispenser according to the present invention, as will be briefly explained herein and as can be easily inferred herefrom by a person skilled in the art. Moreover, it will be appreciated that positional descriptions such as "above", "below", "left", "right" and the like should, unless otherwise indicated, be taken in the context of the figures and should not be considered limiting.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention. The scope of the invention is therefore intended to be limited solely by the scope of the appended claims.

The invention claimed is:

1. An absorbent sheet product dispenser comprising:

a dispenser body having a housing for holding a stack of absorbent sheet products, the housing having a dispensing opening defined in a lower portion thereof through which the absorbent sheet products are withdrawable; and a stand comprising a base and dispenser body support, wherein the base comprises a support surface superposable to a supporting surface, wherein the dispenser body support is securable to the dispenser body in a single configuration, wherein the base and dispenser body support are engageable together in at least two configurations, wherein the base comprises a plurality of grooves on a platform that correspond to the at least two configurations, wherein the dispenser body support comprises at least one flange selectively positionable within at least one of the plurality of grooves on the platform, wherein the dispenser body support pivots about the base at a pivot point comprising a flange extending from an upper portion of the base and mates with a groove in the dispenser body support.

2. The absorbent sheet product dispenser as claimed in claim 1, wherein the base and the dispenser body support are detachably engageable together.

3. The absorbent sheet product dispenser as claimed in claim 1, wherein, once engaged, the base and the dispenser body support are locked in a selected one of the at least two configurations, disengagement between the base and the dispenser body support being required to configure the base and the dispenser body support in a configuration different from the selected one of the at least two configurations.

4. The absorbent sheet product dispenser as claimed in claim 1, wherein the dispenser body and the stand are detachably engageable together.

5. The absorbent sheet product dispenser as claimed in claim 1, wherein the supporting surface is a horizontally oriented supporting surface.

6. The absorbent sheet product dispenser as claimed in claim 1, wherein the dispenser body is closer to a perpendicular orientation with the support surface of the base in at least one of the two configurations.

7. The absorbent sheet product dispenser as claimed in claim 1, wherein the dispensing opening of the dispenser body is further spaced-apart from the support surface of the base in at least one of the two configurations.

* * * * *